US005964550A

United States Patent [19]

Blandford et al.

[11] Patent Number: 5,964,550

[45] Date of Patent: Oct. 12, 1999

[54] MINIMAL PRODUCTION PLATFORM FOR SMALL DEEP WATER RESERVES

[75] Inventors: Joseph W. Blandford; Kent B. Davies, both of Houston; Stephen E. Kibbee, Katy; Steven J. Leverette, Richmond, all of Tex.

[73] Assignee: Seahorse Equipment Corporation, Houston, Tex.

[21] Appl. No.: 08/838,895

[22] Filed: Apr. 11, 1997

Related U.S. Application Data

[60] Provisional application No. 60/018,742, May 31, 1996.

[51] Int. Cl.[6] ..... E02D 5/54; B63B 35/44

[52] U.S. Cl. ..... 405/224; 405/223.1; 405/195.1; 405/204; 114/265

[58] Field of Search ..... 405/195.1, 223, 405/223.1, 224, 224.1, 204, 205; 114/230, 264, 265; 166/341, 342, 353, 354, 368; 52/223.13

[56] References Cited

U.S. PATENT DOCUMENTS

| | | | |
|---|---|---|---|
| 4,386,872 | 6/1983 | Smith | 405/228 X |
| 4,470,723 | 9/1984 | Michel et al. | 405/205 X |
| 4,512,684 | 4/1985 | Hale et al. | 405/217 |
| 4,577,443 | 3/1986 | Kitta et al. | 52/223.13 |
| 4,606,673 | 8/1986 | Daniell | 114/265 X |
| 4,655,642 | 4/1987 | Birdy et al. | 405/217 |
| 4,726,316 | 2/1988 | Bruns | 405/219 X |
| 4,844,659 | 7/1989 | Hunter et al. | 405/224 |
| 5,088,858 | 2/1992 | Massoudi | 405/205 X |
| 5,324,141 | 6/1994 | Hunter et al. . | |
| 5,381,865 | 1/1995 | Blandford | 166/354 X |
| 5,421,676 | 6/1995 | Wybro et al. . | |
| 5,431,511 | 7/1995 | Guy | 405/223.1 |
| 5,433,273 | 7/1995 | Blandford . | |
| 5,507,598 | 4/1996 | Heute | 405/223.1 |
| 5,567,086 | 10/1996 | Heute | 405/223.1 |
| 5,590,982 | 1/1997 | Huete | 405/223.1 |
| 5,690,442 | 11/1997 | Horton | 405/204 X |

*Primary Examiner*—David Bagnell
*Assistant Examiner*—Jong-Suk Lee
*Attorney, Agent, or Firm*—Nick A. Nichols, Jr.

[57] ABSTRACT

In a tension-leg mooring system a production platform supporting one or more decks above the water surface for accommodating equipment to process oil, gas, and water recovered from a subsea hydrocarbon formation is mounted on a single water surface piercing column formed by one or more buoyancy tanks located below the water surface. The surface piercing column includes a base structure comprising three or more pontoons extending radially outwardly from the bottom of the surface piercing column. The production platform is secured to the seabed by one or more tendons per pontoon which are secured to the pontoons at one end and anchored to foundation piles embedded in the seabed at the other end.

6 Claims, 5 Drawing Sheets

MINIMAL PRODUCTION PLATFORM FOR SMALL DEEP WATER RESERVES

RELATED APPLICATIONS

This application claims the benefit of U.S. Provisional Application Ser. No. 60/018,742 file on May 31, 1996.

BACKGROUND OF THE DISCLOSURE

The present invention is directed to a method and apparatus for testing and producing hydrocarbon formations found in deep (600–10,000 feet) offshore waters, and in shallower water depths where appropriate, particularly to a method and system for economically producing relatively small hydrocarbon reserves in mid-range to deep water depths which currently are not economical to produce utilizing conventional technology.

Commercial exploration for oil and gas deposits in U.S. domestic waters, principally the Gulf of Mexico, is moving to deeper waters (over 600 feet) as shallow water reserves are being depleted. Companies must discover large oil and gas fields to justify the large capital expenditure needed to establish commercial production in these water depths. The value of these reserves is further discounted by the long time required to begin production using current high cost and long lead-time designs. As a result, many smaller or "lower tier" offshore fields are deemed to be uneconomical to produce. The economics of these small fields in the mid-range water depths can be significantly enhanced by improving and lowering the capital expenditure of methods and apparatus to produce hydrocarbons from them. It will also have the additional benefit of adding proven reserves to the nation's shrinking oil and gas reserves asset base.

In shallow water depths (up to about 300 feet), in regions where other oil and gas production operations have been established, successful exploration wells drilled by jack-up drilling units are routinely completed and produced. Such completion is often economically attractive because light weight bottom founded structures can be installed to support the surface-piercing conductor pipe left by the jack-up drilling unit and the production equipment and decks installed above the water line, which are used to process the oil and gas produced from the wells. Moreover, in a region where production operations have already been established, available pipeline capacities are relatively close, making pipeline hook-ups economically viable. Furthermore, since platform supported wells in shallow water can be drilled or worked over (maintained) by jack-up rigs, shallow water platforms are not usually designed to support heavy drilling equipment on their decks, unless jack-up rigs go into high demand. This enables the platform designer to make the shallow water platform light weight and low cost, so that smaller reservoirs may be made commercially feasible to produce.

Significant hydrocarbon discoveries in water depths over about 300 feet are typically exploited by means of centralized drilling and production operations that achieve economies of scale. For example, since typical jack-up drilling rigs cannot operate in waters deeper than 300 feet, a platform's deck must be of a size and strength to support and accommodate a standard deck-mounted drilling rig. This can add 300 to 500 tons to the weight of the deck, and even more to the weight of the substructure. Such large structures and the high costs associated with them cannot be justified unless large oil or gas fields with the potential for many wells are discovered.

Depending on geological complexity, the presence of commercially exploitable reserves in water depths of 300 feet or more is verified by a program of drilling and testing one or more exploration and delineation wells. The total period of time from drilling a successful exploration well to first production from a central drilling and producing platform in the mid-range water depths typically ranges from two to five years.

A complete definition of the reservoir and its producing characteristics is not available until the reservoir is produced for an extended period of time, usually one or more years. However, it is necessary to design and construct the production platform and facility before the producing characteristics of the reservoir are precisely defined. This often results in facilities with either excess or insufficient allowance for the number of wells required to efficiently produce the reservoir and excess or insufficient plant capacity at an offshore location where modifications are very costly.

Production and testing systems in deep waters in the past have included converting Mobile Offshore Drilling Units ("MODU's") into production or testing platforms by installing oil and gas processing equipment on their decks. A MODU is not economically possible for early production of less prolific wells due to its high daily cost. Furthermore, now that the market has tightened, such conversions are not considered economical. Similarly, converted tanker early production systems, heretofore used because they were plentiful and cheap, are also not economical for less prolific wells. In addition, environmental concerns (particularly in the U.S. Gulf of Mexico) have reduced the desirability of using tankers for production facilities instead of platforms. Tankers are difficult to keep on station during a storm, and there is always a pollution risk, in addition to the extreme danger of having fired equipment on the deck of a ship that is full of oil or gas liquids. This prohibition is expected to spread to other parts of the world as international offshore oil producing regions become more environmentally sensitive.

Floating hydrocarbon production facilities have been utilized for development of marginally economic discoveries, early production and extended reservoir testing. Floating hydrocarbon production facilities also offer the advantage of being easily moved to another field for additional production work and may be used to obtain early production prior to construction of permanent, bottom founded structures. Floating production facilities have heretofore been used to produce marginal subsea reservoirs which could not otherwise be economically produced. Production from a subsea wellhead to a floating production facility is realized by the use of a substantially neutrally buoyant flexible production riser oriented in a broad arc. The broad arc configuration permits the use of wire line well service tools through the riser system.

FPS (Floating Production System) consists of a semi-submersible floater, riser, catenary mooring system, subsea system, export pipelines, and production facilities. Significant system elements of an FPS do not materially reduce in size and cost with a reduction in number of wells or throughput. Consequently, there are limitations on how well an FPS can adapt to the economic constraints imposed by marginal fields or reservoir testing situations. The cost of the semi-submersible vessel (conversion or new build) and deep water mooring system alone would be prohibitive for most of these applications. In addition, semi-submersibles are now being fully utilized in drilling operations and are not available for conversion into FPS.

A conventional TLP (Tension Leg Platform) consists of a four column semi-submersible floating substructure, multiple vertical tendons attached at each corner, tendon anchors to the seabed, and well risers. A variation of the conventional TLP, a single leg TLP, has four columns and a single tendon/well riser assembly. The conventional TLP deck is supported by four columns that pierce the water plane. These types of TLP's typically bring well(s) to the surface for completion and are meant to support from 20 to 60 wells at a single surface location.

It is therefore an object of the present invention to provide a tension-leg mooring system which suppresses substantially all vertical motions. The mooring configuration of the present invention makes it possible to have a single, stable column piercing the surface of the water with a small water plane area.

It is another object of the invention to provide a tension-leg mooring system having a single surface-piercing column permitting the hull and deck to be independently designed and optimized.

It is another object of the invention to provide a tension-leg mooring system utilizing a foundation having either driven piles, drilled and grouted piles, or suction piles. Redundancy may be incorporated by using a template with additional piles.

It is another object of the invention to provide a tension-leg mooring system wherein the tendons are pre-installed to the foundation and are allowed to float in a more or less vertical configuration until the hull is mobilized to the site and connection to the hull is made.

It is yet another object of the invention is to provide a tension-leg mooring system having a hull which may be wet-towed or dry-towed to the location. After the hull is connected to the pre-installed tendons, the deck sections may be lifted into place.

It is a further object of the invention to provide a tension-leg mooring system wherein the platform has relatively large base dimensions, thereby increasing tendon separation and improving their effectiveness.

It is still another object of the invention is to provide an tension-leg mooring system wherein the key platform components may be standardized.

SUMMARY OF THE INVENTION

The present invention provides a system for producing and processing well fluids produced from subsea hydrocarbon formations. The tension-leg mooring system includes a production platform supporting one or more decks above the water surface for accommodating equipment to process oil, gas, and water recovered from the subsea hydrocarbon formation. The production platform includes a single water surface piercing column formed by one or more buoyancy tanks located below the water surface. The surface piercing column includes a base structure comprising three or more pontoons extending radially outwardly from the bottom of the surface piercing column. The production platform is secured to the seabed by one or more tendons which are secured to the pontoons at one end and anchored to foundation piles embedded in the seabed at the other end.

BRIEF DESCRIPTION OF THE DRAWINGS

So that the manner in which the above recited features, advantages and objects of the present invention are attained can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
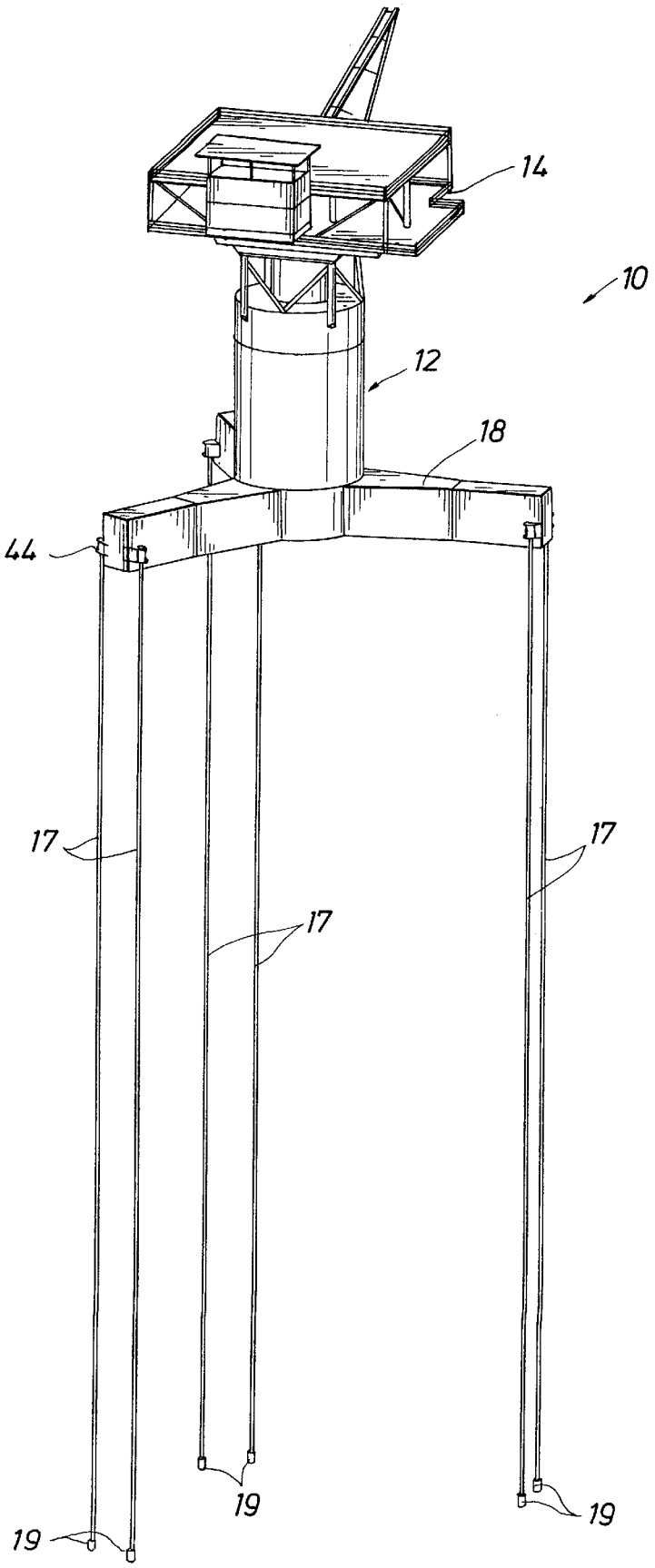
FIG. 1 is a side elevation view of the single column tension-leg mooring system of the invention.

Referring first to FIG. 1, the tension leg production platform of the invention is generally identified by the reference numeral 10. The production platform 10 includes a hull 12 which provides positive buoyancy and vertical support for the entire production platform 10 and supports a production deck 14 which is large enough to accommodate the equipment necessary to fully or partially control and process the oil, gas and water produced from the subsea reservoir.

The hull 12 comprises a single surface piercing column extending upward from a base or barge formed by pontoons 18. The hull 12 provides sufficient buoyancy to support the deck 14, production facilities and flexible risers, and has sufficient excess buoyancy to develop the design tendon pre-tension. The production platform 10 is anchored to the seabed by tendons 17 which are secured to the pontoons 18 at the upper ends thereof and to foundation piles 19 embedded in the seabed at the lower ends thereof.

The hull 12 is fabricated of stiffened plate and stiffened shell construction. In the preferred embodiment of FIG. 1, three radially extending legs or pontoons 18 form the base of the hull 12. It is understood however that fewer or a greater number of pontoons 18 may be incorporated in the design of the hull 12. The pontoons 18 extend radially outward from the longitudinal axis of the hull 12 and are equally spaced from each other.

Figure 2:
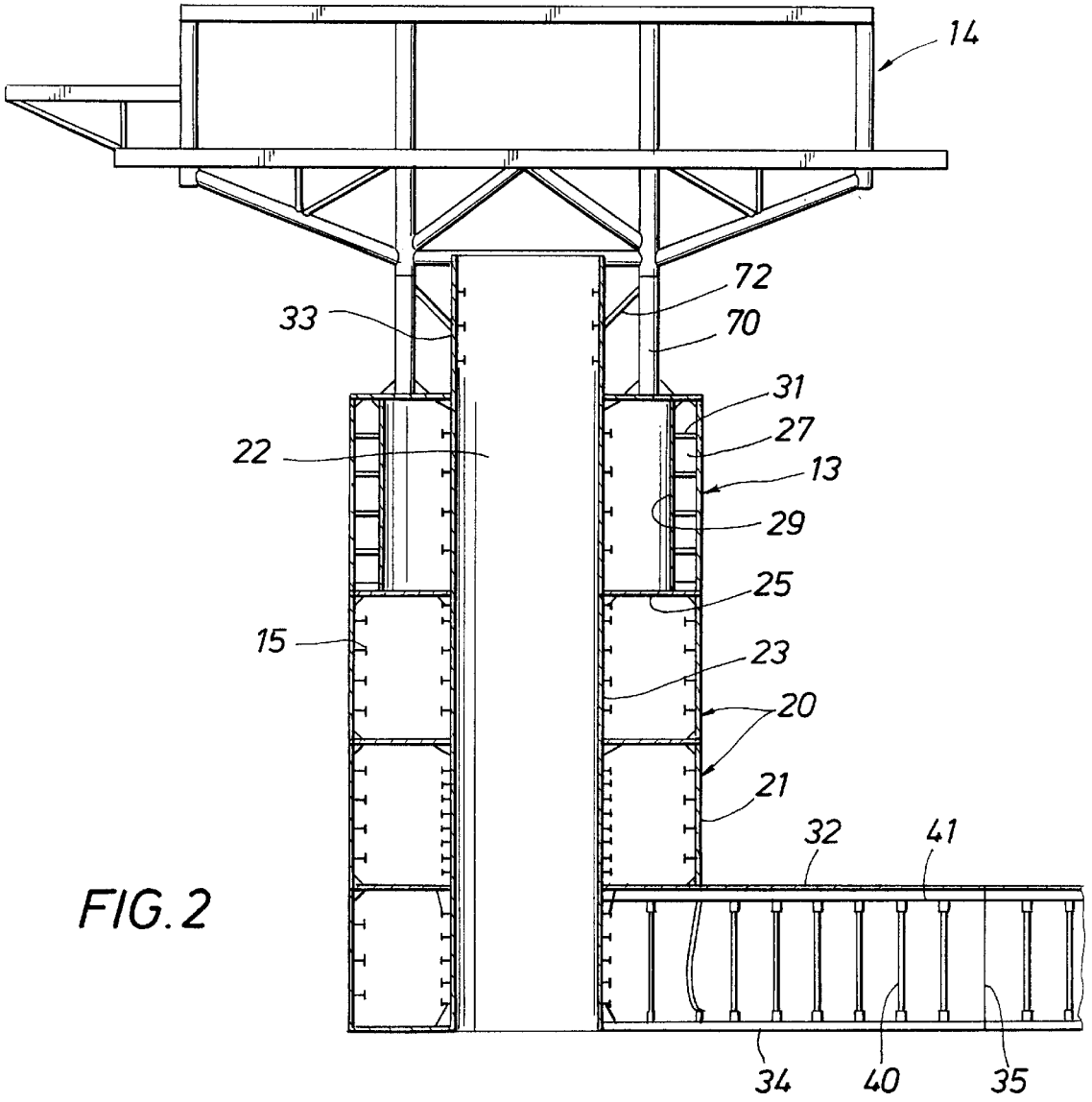
FIG. 2 is a section view of the hull and pontoon base of the invention.

The configuration of the hull 12 is designed for ease of fabrication. In addition, both the hull 12 and the pontoons 18 are compartmentalized for limiting the effects of accidental damage. The hull 12 includes a plurality of stacked buoyancy tanks 20. The tanks 20, as best shown in FIG. 2, include an outer wall 21 and an inner wall 23 defining a ballast chamber therebetween. The walls 21 and 23 have top and bottom edges. A top horizontal plate 25 welded to the top edges of the walls 21 and 23 completes the substantially cylindrical structure of the buoyancy tanks 20 which, prior to assembly of the hull 12, are open at the bottom end. Additional structural integrity for the tanks 20 is provided by stiffener flanges 15 welded to the inner surface of the tank walls 21 and 23. The stiffener flanges 15 are about three inches in width and one inch thick substantially equally spaced along the walls 21 and 23 of the tanks 20. The tanks 20 further include an axial passage extending therethrough, which axial passage is open at each end.

The uppermost buoyancy tank 20, generally identified by the reference numeral 13, is provided with an internal damage control chamber 27 formed between an internal wall 29 and the outer wall 21 of the uppermost tank 13. The chamber 27 is divided into one or more compartments by spacer rings 31 mounted between the walls 21 and 29. The damage control chamber 27 provides a safety zone about the hull 12 at the water line. In the event a boat or other object strikes the hull 12 at the water line, the area subject to the highest risk of collision from boat traffic, flooding of the hull 12 will be limited to the damage control chamber 27.

The ballast tanks 20 are stacked one on the other and welded to form the single column of the hull 12. Upon welding one tank 20 on another, the top plate 25 of the lower tank 20 forms the bottom of the tank 20 directly above it. The axial passages extending through the ballast tanks 20 are aligned to form a central axial chamber 22 closed at its lower and upper ends. The chamber 22 is empty and provides internal access to the hull 12. The upper end of the chamber 22 is defined by a cylindrical extension 33 welded to the top of the uppermost tank 20. The extension 33 projects above the uppermost tank 13, providing access to the axial chamber 22 from topside. The chamber 22 and extension 33 additionally house the internal plumbing and valving for the ballast system of the platform 10 which permits the operator to selectively flood or empty the tanks 20 and the pontoons 18.

The ballast system of the invention serves to adjust draft during transportation and installation and may be used for de-watering in the case of emergency flood conditions. Since any variable components of payload are relatively small for a non-drilling structure, the tendons 17 and pre-tension can be and are designed to accommodate minor day to day weight condition changes without ballast changes. The ballast system of the platform 10 is intended to be operated during installation and emergency conditions, and is therefore less complex than a ballast system which must remain in continuous active operation for the life of the platform. The ballast pump is designed to be recovered to topside for service or replacement at any time.

Figure 3:
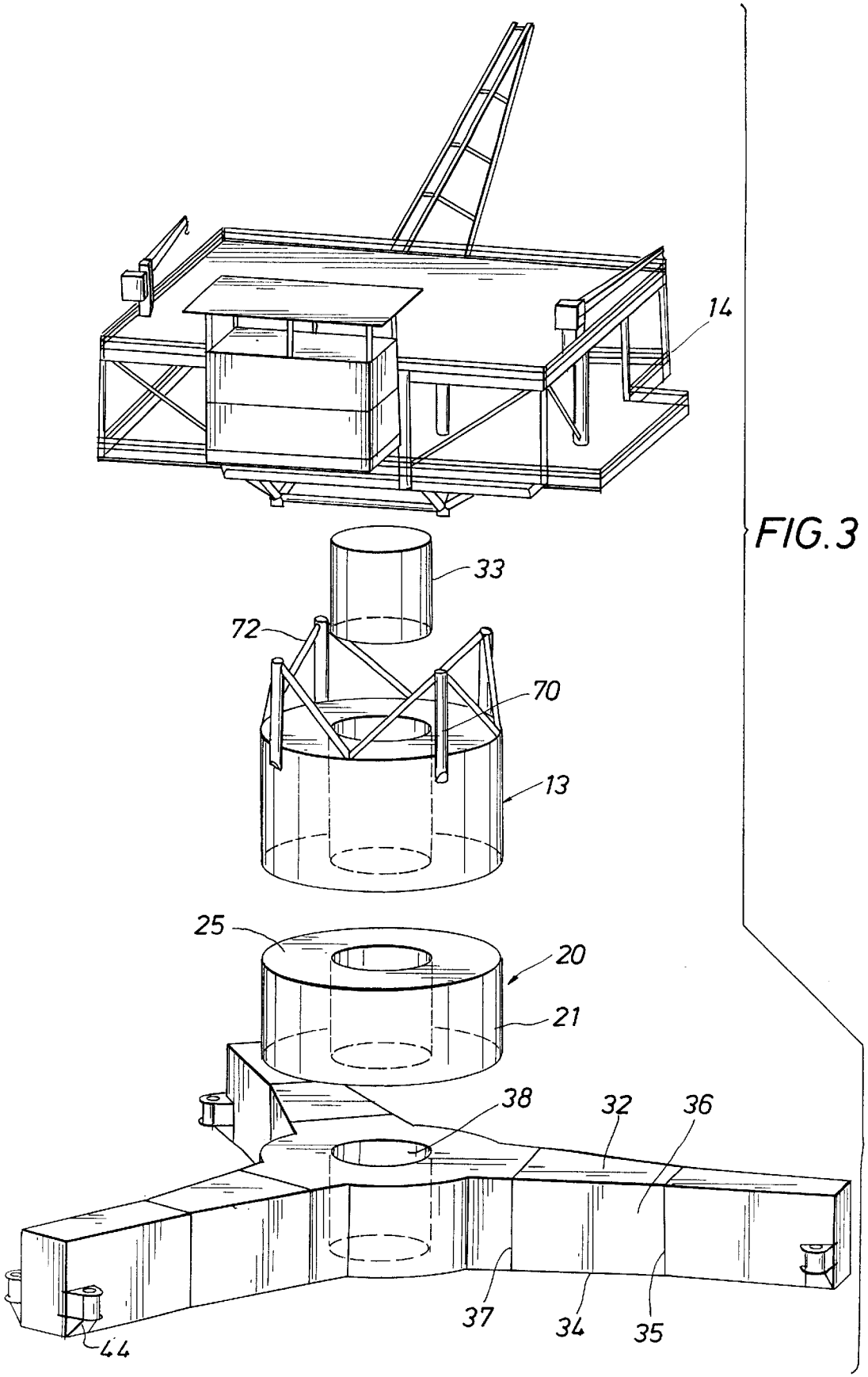
FIG. 3 is an exploded view of the single column tension-leg mooring system of the invention.

Referring now to FIGS. 2 and 3, the pontoons 18 form the base of the platform 10 and extend radially outwardly from the bottom of the stacked tanks 20 forming the single column of the hull 12. In the preferred embodiment of FIG. 3, the pontoons 18 comprise modular components which are welded together at 35 and 37 to form the base of the platform 10. It is understood that such modular construction is depicted for illustrative purposes. The base of the platform 10 may be a single unitary component. However, depending on the size of the platform 10, the pontoons 18 may extend seventy (70) or more feet outward from the hull 12. Thus, it may be expedient economically and for fabrication purposes to construct the pontoons 18 in modules which are welded together to form the base of the platform 10.

Figure 4:
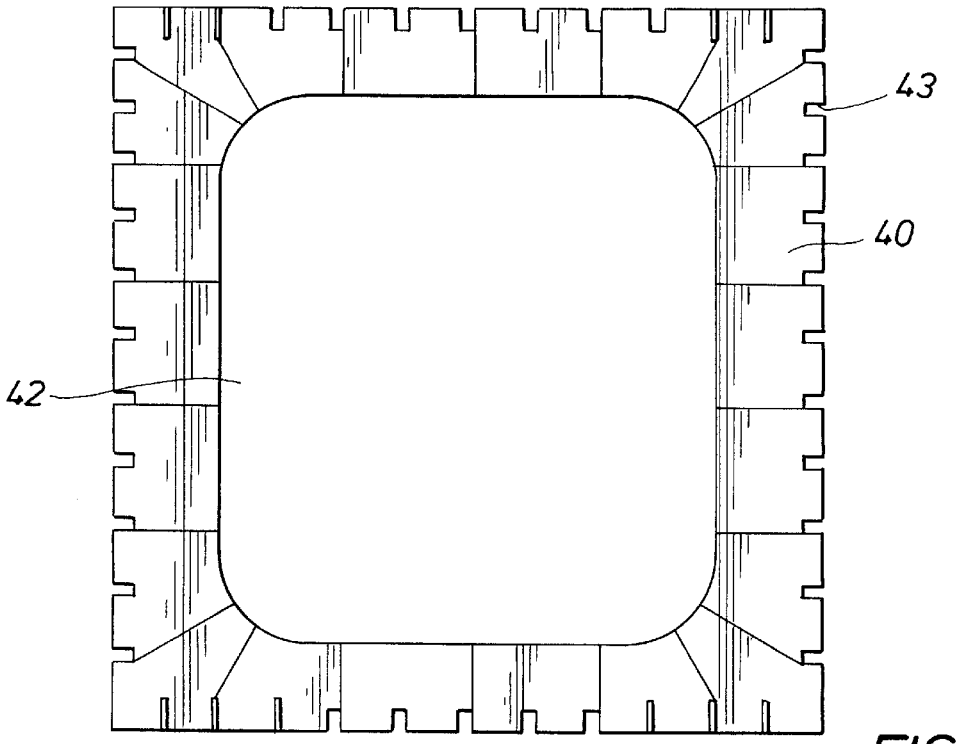
FIG. 4 is a side view of a web frame support member of the tension-leg mooring system of the invention.
Figure 5:
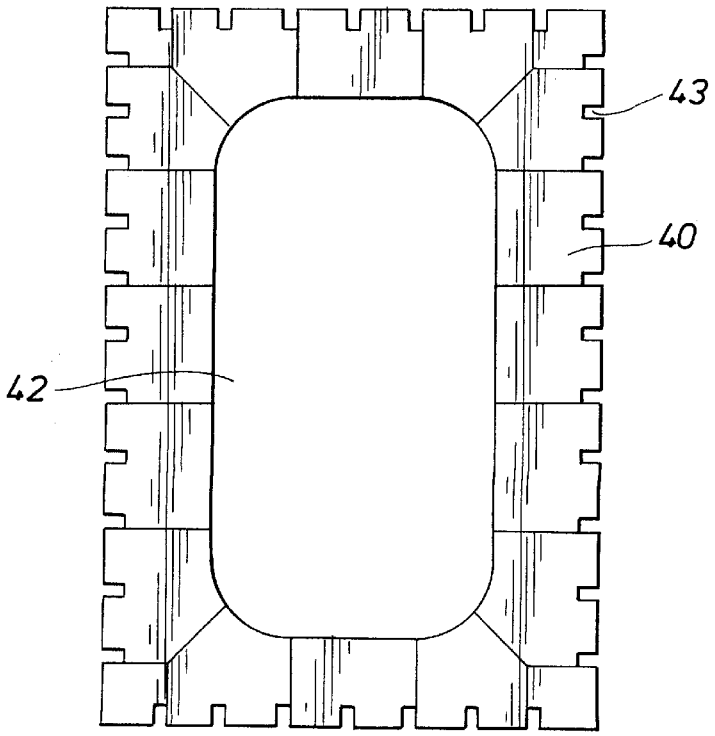
FIG. 5 is a side view of an alternate embodiment of a web frame support member of the tension-leg mooring system of the invention.

Referring still to FIG. 3, the pontoons 18 include top and bottom horizontal plates 32 and 34 spaced from each other and connected by sidewalls 36 and an internal cylindrical wall 38. To optimize the base structure for carrying tendon induced bending moments, it will be observed that the pontoons 18 taper slightly inwardly toward their distal ends. As best shown in FIG. 2, the structural integrity of the pontoons 18, which are the primary load bearing members of the hull 12, is further enhanced by web frame members 40. The web frame members 40 are internally welded to the top and bottom plates 32 and 34 and the sidewalls 36, and are substantially equally spaced internally along the length of the pontoons 18. The web frame members 40, as best shown in FIGS. 4 and 5, comprise structural support plates approximately one inch thick, which plates include a perimeter portion approximately three inches in width. The perimeter portion circumscribes an opening 42 in the web frame members 40. The perimeter of the frame members 40 is slotted to receive the stiffener flanges 41 reinforcing the walls of the pontoons 18. The web frame slots 43 are sized to receive the flanges 41 and are welded thereto.

Figure 7:
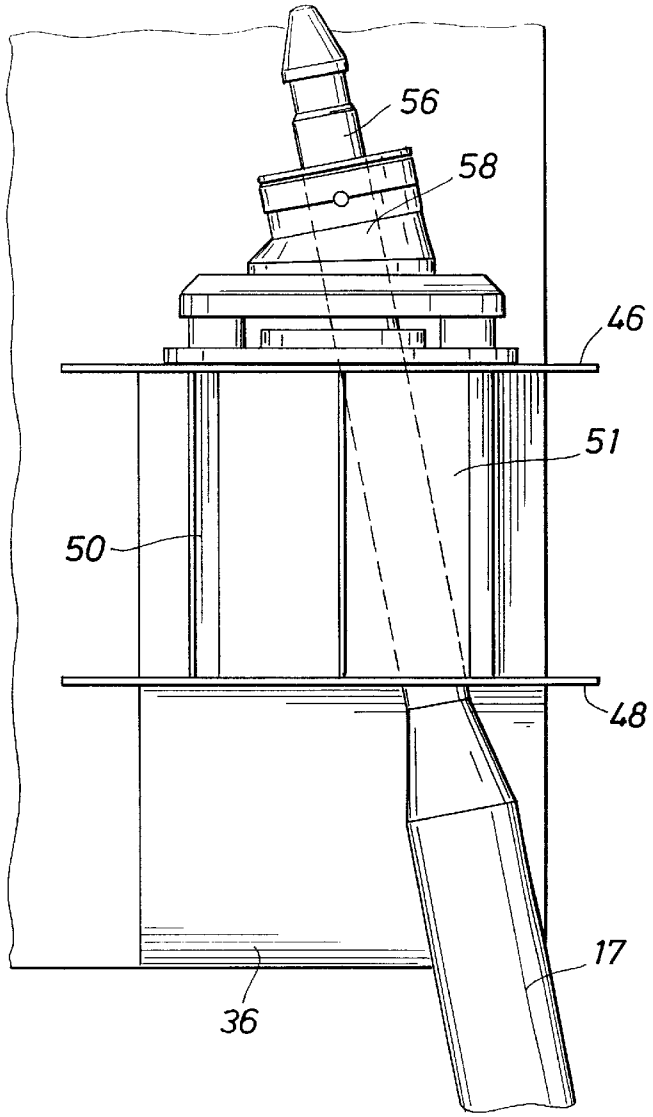
FIG. 7 is a partial sectional side of the tendon support porch of the invention depicting a tendon mounted thereon.
Figure 6:
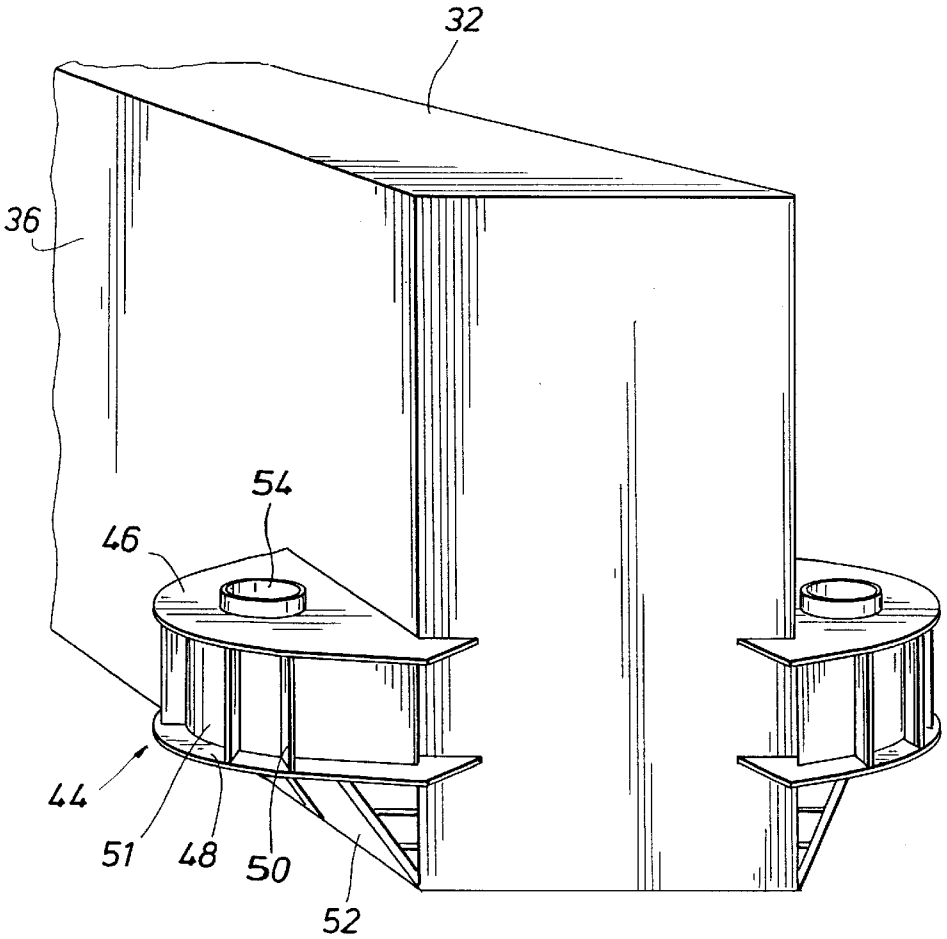
FIG. 6 is a partial perspective view of the tendon support porch of the invention.

Referring now to FIG. 6, tendon porches 44 are mounted about midway along the sidewalls 36 of the pontoons 18 at the distal ends thereof. The tendon porches 44 include top and bottom spaced flange members 46 and 48 reinforced by support members 50 and 51. Additional structural support is provided by angular support members 52. The tendon porches include an axial passage 54 for receiving a tendon connector 56 therethrough. The tendon connector 56, as best shown in FIG. 7, enters the passage 54 from below the tendon porch 44 and projects above the porch 44. The tendon connector 56 includes an externally threaded portion. A tendon collar 58 is threaded on the tendon connector 56 and may be adjusted along the threaded portion of the tendon connector 56 to develop the platform design tension pretension.

Figure 8:
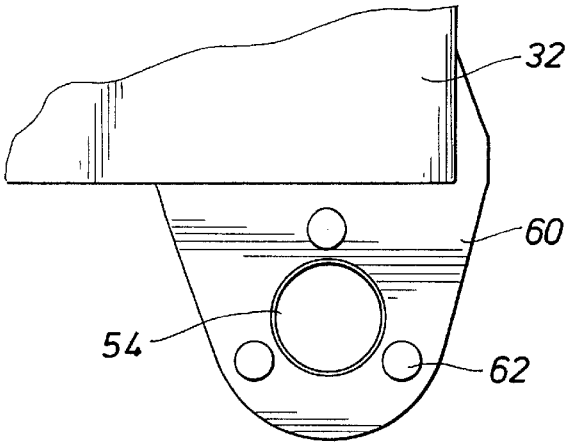
FIG. 8 is a partial plan view of an alternate embodiment of the tendon support porch of the invention.

Referring now to FIG. 8, an alternate tendon porch design is shown. The tendon porch 60 shown in FIG. 8 includes one or more load cells 62 embedded in the structure of the porch 60. The load cells 62 are positioned for engagement with the bottom surface of the tendon collar 58 shown in FIG. 7. The load cells 62 monitor the tendon load forces so that adjustments may be made to maintain the design tendon pretension for each tendon 17.

Referring again to FIG. 1, the deck 14 provides a stable working platform safely above hurricane wave crest heights to support the production equipment necessary to process and control production. The deck 14 may be installed after the hull 12 is installed at the off-shore site. The deck 14 and hull 12 may be optimized separately during the design stage and built in different locations. When the design of the hull 12 and deck 14 are mutually dependent, the marine considerations which effect the design of the hull 12 also impact the dimensions of the deck 14.

The deck 14 supported by the hull 12 may vary from a simple production platform to the multi-level deck structure shown in FIGS. 2 and 3. The deck 14 is supported on a deck substructure formed by support columns 70 and bracing members 72 mounted to the uppermost tank 13 of the hull 12. The deck 14 configuration facilitates reuse of the hull 12 because the deck 14 may be removed by cutting and lifting the deck 14 off of the support columns 70. The hull 12 may then be refitted with a new deck and new production facilities and redeployed to a new location having different water depths, with new facilities.

The deck 14 may include one or more levels of varying size dimensions, for example, 110 feet by 110 feet. Depending on site specific requirements, the deck 14 may be larger or smaller. The ability to provide affordable deck space near the subsea wells has several economic and operational benefits for the platform 10 compared to long reach subsea production systems. Since the flow lines are short, individual flow lines to each well are affordable. Short flow lines also make it affordable to equip each subsea well with a second flow line for a wax removal pigging circuit. The short distance from the production platform 10 to the subsea well also makes it possible to control the subsea tree with simpler control systems and allows emergency coil tubing operations to keep the flow lines clear of wax and sand deposits which may impede flow. In addition, shorter flow lines reduce pressure drop and back pressure on wells thereby increasing producing rates and recovery.

The production platform 10 is anchored to a foundation template or to the individual foundation piles 19 by tubular steel tendons 17. Tendon systems have been intensively researched for TLP applications and the necessary technology is well established. The tendon system of the present disclosure comprises one or two tendons 17 per pontoon 18. The tendons 17 are connected to the distal ends of the pontoons 18 as shown in FIG. 1. The choice between one or more tendons per pontoon is primarily one of size, desired redundancy and cost.

Tendons may be installed either as a single piece or segmented as joints. Both options have been well established by previous practice. The single piece tendons may be applicable when suitable fabrication facilities are located near the installation site, so that the tow distance is relatively short and can be traversed during a predictable weather window. Each single tendon is usually designed neutrally buoyant so that it rides slightly below the surface of the water during tow out. The end connectors of the tendons are supported by buoyancy tanks. The upper buoyancy tank is larger than the lower tank and serves to hold the tendon upright before the hull 12 is installed as described in greater detail in U.S. Pat. No. 5,433,273 to Blandford.

Segmented tendons are applicable when single piece tendons are not practical for reasons of limited space at the fabrication site, transportation to the offshore installation site or economics. In this approach, tendon segments are shipped to location on a barge and stalked as each tendon segment is lowered. Alternatively, the tendon segments may be run from a drilling unit in a manner similar to a drilling riser. In either case, a temporary or permanent buoy on the top of the tendon is included to hold the tendons upright until the hull is installed.

The hull 12 is anchored by the tendons 17 to the foundation template or piles 19. The foundation template is anchored to the seabed by a plurality of piles either driven, drilled and grouted or installed by suction or other mechanical means to the seabed. The main advantage of the drilled and grouted piles is that the installation can be done without a derrick barge.

Installation of the production platform 10 is accomplished by first anchoring the foundation template or piles 19 to the seabed. The tendons 17 are towed to the offshore site and connected to the foundation piles 19. The tendons 17 are oriented vertically. The hull 12 may be towed to the offshore site or may be taken out on a barge, i.e. dry towed. The hull 12 is positioned near the location of the vertically oriented tendons 17. Ballasting the hull 12 lowers it into the water for connection with the tendons 17. During ballasting, it may be desirable to exert an upward pull on the top of the hull 12 to keep it stable as it is ballasted. As the hull 12 is lowered, the upper ends of the tendons 17 are directed through the tendon porches 44 and the tendon collars 58 are threaded thereon. The hull 12 is then deballasted to place the tendon 17 in tension. The deck 14 and production facilities are mounted on the hull 12 and ballasting of the hull 12 is adjusted to develop the design tension for the production platform 10.

The production platform 10 of the invention with its single surface-piercing hull 12 is relatively transparent to environmental forces and is designed to carry a range of payloads. The design utilizes a plurality of stacked buoyancy tanks 20 to achieve a concentricity of buoyancy, thereby resulting in a relatively small base, yet still suppressing heave motions and reducing lateral excursions. Wave loads on the hull 12 are further controlled by the upper cylindrical column 33 on the uppermost buoyancy tank 13. Small waves act only on the large diameter tank 20, thereby minimizing fatigue loading on the hull 12. During high seas, the crest loads of large waves are reduced because of the smaller diameter of the upper column 33.

While the foregoing is directed to the preferred embodiment of the present invention, other and further embodiments of the invention may be devised without departing from the basic scope thereof, and the scope thereof is determined by the claims which follow.

We claim:

1. A tension-leg platform comprising:

(a) a hull having a single surface-piercing column supporting one or more decks above the water surface for accommodating hydrocarbon process equipment thereon, wherein said hull includes two or more vertically stacked buoyancy tanks forming said surface-piercing column and further including a vertically extending reduced diameter column secured on the uppermost of said buoyancy tanks above the water surface;

(b) said hull including a base secured at the lower end of said surface-piercing column, said base comprising a substantially cylindrical body having three or more pontoons extending radially outwardly therefrom, said pontoons having proximal and distal ends;

(c) wherein said pontoons include tendon support means mounted at the distal ends thereof, and further include one or more load cells embedded in said tendon support means; and (d) anchor means securing said hull to the seabed.

2. The tension-leg platform of claim 1 wherein each of said buoyancy tanks and said base include an axial opening extending therethrough, said axial openings forming an axial access shaft upon assembly of said buoyancy tanks and said base in vertical alignment.

3. The tension-leg platform of claim 1 wherein said pontoons include a plurality of stiffener members internally spaced along the length of said pontoons.

4. The tension-leg platform of claim 1 including a detachable deck supported on said surface-piercing column by support columns mounted on the uppermost of said buoyancy tanks.

5. The tension-leg platform of claim 1 wherein said pontoons taper inwardly in cross-section toward the distal ends thereof.

6. The tension-leg platform of claim 1 wherein said buoyancy tanks include one or more circumferential stiffener members internally spaced along the length of said buoyancy tanks.

* * * * *